US006029356A

United States Patent [19]

Sprinkle

[11] Patent Number: 6,029,356

[45] Date of Patent: Feb. 29, 2000

[54] FINGER PAD SENSOR RAZOR

[76] Inventor: Brenda L. Sprinkle, 23485 Watauga Rd., Abingdon, Va. 24211

[21] Appl. No.: 09/329,082

[22] Filed: Jun. 9, 1999

Related U.S. Application Data

[63] Continuation-in-part of application No. 09/103,252, Jun. 23, 1998.

[51] Int. Cl.[7] ..... B26B 21/08

[52] U.S. Cl. ..... 30/298; 30/526

[58] Field of Search ..... 30/298, 296.1, 30/30, 340, 232, 526

[56] References Cited

U.S. PATENT DOCUMENTS

| | | | |
|---|---|---|---|
| 647,862 | 4/1900 | McLaughlin | 30/298 X |
| 1,074,864 | 10/1913 | Howell | 30/298 |
| 1,365,952 | 1/1921 | Raymer | 30/298 X |
| 2,888,745 | 6/1959 | Beck | 30/298 X |
| 4,467,873 | 8/1984 | Kaatz | 30/298 X |

*Primary Examiner*—Douglas D. Watts

[57] ABSTRACT

A ring razor for persons having finger, hand or arm problems such as arthritis, shaking or the like whereby control of the razor motion is difficult, wherein the razor is mounted on full or partial rings which slide all the way over the fingers to their proximal ends for stability and for allowing the finger ends to be used as sensory feed-back means of hair stubble condition such that the user will know when to shave closer if desired, and to allow user of the finger tips to motionally stabilize and direct the razor strokes in a safe and efficient manner.

8 Claims, 3 Drawing Sheets

FINGER PAD SENSOR RAZOR

This application is a continuation-in-part of applicants pending Ser. No. 09/103,252 filed Jun. 23, 1998.

BACKGROUND OF THE INVENTION

1. Field

This invention concerns finger attached cutting implements such as hair removal razors wherein very sensitive control of the implement and its pressure against the skin is required, and wherein the manipulative ability of the fingers to which the implement is attached has been comprised thru accident or medical condition such as arthritis or uncontrollable shaking of the arm, fingers or hand.

2. Prior Art

Razor devices and finger mountings therefor have been proposed such as shown and described in U.S. Pat. Nos. 1,201,317; Des. 386,819; 3,045,342; 5,357,680; and 971,772. These devices are typically affixed at or near the tip ends of one or more of the fingers which are normally used to hold a conventional razor. Thus the ends of the fingers, especially the tip pads, provide the cutting pressures directly to the devices.

Also previously proposed finger mounted devices are shown in U.S. Pat. No. 1,074,864 and U.K. publication 2,265,105, neither of which can provide applicant's tactile monitoring of hair stubble condition thru the pressure sensitive finger pads.

With the use of such prior devices, therefore, a large portion if not all, of the tactile sensory capacity of the tip pads has been lost simply by its transference to the physical mechanical structure of the razor device. Also, where a shaking of the hand, arm or fingers is involved, the difficulties in controlling the razor are greatly magnified simply thru the force moment arm provided by finger length.

OBJECTS OF THE INVENTION

Objects therefore of the present invention are:

to provide a simply and inexpensively constructed finger mountable razor device which is easily useable with medically compromised fingers and which does not interfere with the use of the finger tips in providing sensory feed-back of hair stubble condition to the user such that further razor strokes can be made if necessary;

to provide such device with finger mounting structure which affords enhanced razor control to the user, particularly where the user suffers from a finger, hand or arm shaking condition, or where some paralysis of the arm, fingers or hand may be involved; and to provide such device which is fully disposable or which is structured to allow easy replacement of the blade.

SUMMARY OF THE INVENTION

The above and other objects have been attained in accordance with the present invention which is defined in its broad sense as a ring razor, i.e., a finger mountable razor device having a base with at least two substantially tubular shaped finger gripping members such as rings or partial rings having substantially parallel longitudinal bore axes which are coextensive with finger axes and being supported on top of said base, each said gripping member having a lower bore portion lying in a finger pad first plane, each said gripping member being dimensioned to slidably, frictionally and longitudinally axially receive a finger substantially all the way to its proximal end while leaving the distal end of the finger exposed for sensory contact with the users skin, and razor blade means having a shaving edge and being mounted on the bottom of said base, said shaving edge being oriented substantially laterally to said longitudinal axis in a shaving second plane, said longitudinal axes, said finger pad first plane and said shaving second plane being spaced apart successively from top to bottom of said device whereby, in concert with the shaving edge being oriented substantially laterally to said bore and finger axes, a stroking motion of the hand generally axially of the forearm with the present device mounted on fingers will effect a hair shaving action with an attendant tactile monitoring by the pads of said finger of the hair stubble condition.

The invention as described above offers many advantages such as the following:

a. provides more dexterity in that the fingers, particularly when medically comprised, are not as involved with the movement of the razor;

b. this is primarily a ladies product, but not exclusively, and as persons shave with the ring razor they can monitor with the tips of their fingers the closeness of the shave and can immediately re-shave the areas needed. This is quite important since when women shave their legs their line of sight is limited, particularly when showering;

c. attached near the palm of the hand by the rings, the razor is less likely to slip, the user has more control and little or no finger movement is necessary. This is especially important with a person who has limited finger movement due to a disability or injury;

d. may be used with the hand completely extended with no bending of hand or fingers. Provides for a close shave since the device is mounted near the end pads which makes this is a hand controlled razor versus a finger controlled device;

e. dropping the razor is eliminated with a ring fit near the pads;

f. easily usable with a disposable type blade;

g. for men using the device, it would be an excellent product in the shower as shaving could be accomplished by using the finger tips to feel any stubble left. There is no need for a mirror;

h. this device employs a persons gross motor skills (hand) instead of fine motor skills (fingers);

I. is easily transferred from right to left hand.

j. men or women with trembling hands could use this device easily. The hand and fingers could rest on one's face/legs providing a balance. This could not be accomplished with a razor attached to the finger tips; and k. no need for finger gripping or finger bending.

BRIEF DESCRIPTION OF THE DRAWINGS

The invention will be further understood from the following drawings and description thereof wherein portions of the device are enlarged for clarity.

Figure 1:
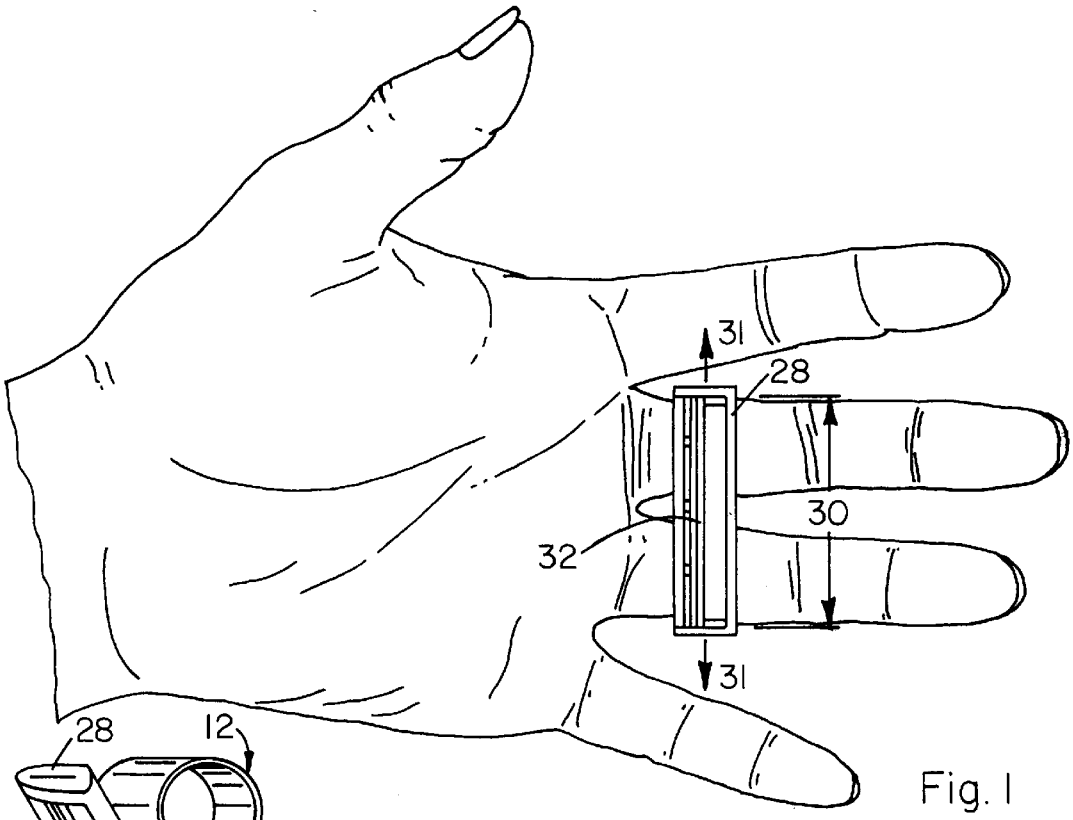
FIG. 1 is a hand palm view of the device mounted on adjacent fingers.

Referring to the drawings and with particular reference to the claims hereof, the present finger mountable razor device comprises base means 10 having at least two full or partial sleeve or ring members 12, 14 supported thereon and having longitudinal axes 16 preferably oriented substantially parallel to each other and having a lower bore portion 17 lying in a finger pad first plane 18. Each of said ring members are radially dimensioned to slidably, frictionally receive a finger 19 substantially all the way to its proximal end 20, and having an axial dimension 22 of from about one half inch to about three inches, preferably of from about one half to about one inch, the larger axial dimensions being adapted to stabilize the first joint 24 of the finger while learning the distal end 26 of the finger exposed for sensory purposes. Razor blade head means 28 is mounted on said base means 10 and has an elongated dimension 30 oriented along a lateral direction 31 for supporting an elongated razor blade 32 in a shaving second plane 34, said lateral direction 31 being oriented generally normal to said longitudinal axes 16. The first and second planes 18 and 34 are spaced apart and preferably substantially parallel, whereby a stroking motion of the hand with the present device thereon will effect a hair shaving action with attendant razor stabilization and also monitoring by the finger pads 21 and also, if desired, by portions of the thumb pad 35 and adjacent palm area 37, of the hair stubble condition.

Figure 3:
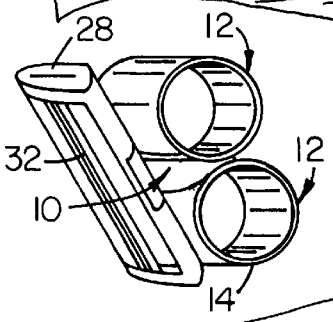
FIG. 3 is an isometric view of one embodiment of the device.
Figure 2:
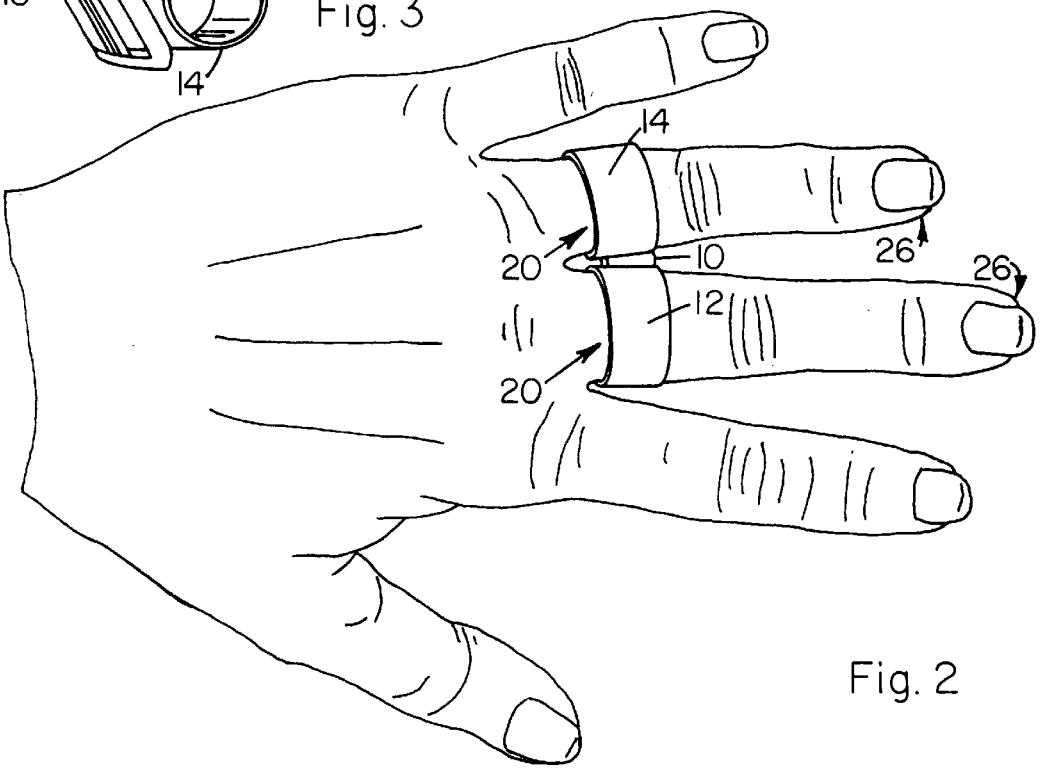
FIG. 2 is a back hand view of the mounted device of FIG. 1.
Figure 4:
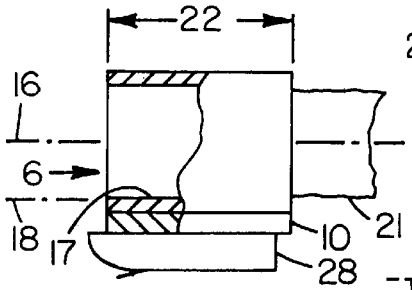
FIG. 4 is a side view of the device of FIG. 3 with portions broken away for clarity and with the head or blade support shown in cross-section.
Figure 5:
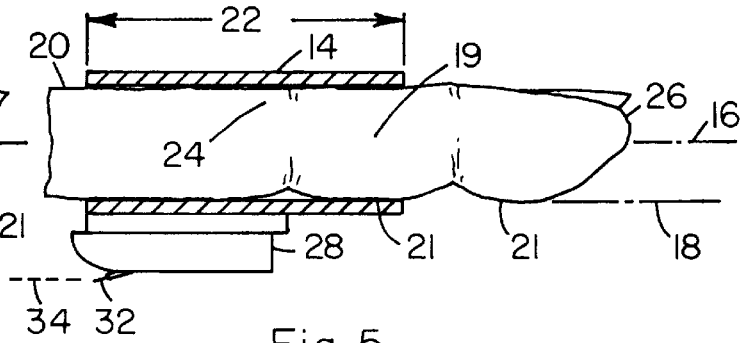
FIG. 5 is a side view, partially in cross-section, of a variation of the device employing a first joint stabilizer.

The drawings, particularly FIGS. 3, 4 and 5 show that the razor blade head means 28 in which the actual blade 32 is mounted can also serve as the base means 10 and be directly affixed to the rings 14, 16. In such case the whole assembly of rings, base, head means and blade can be disposable.

Figure 6:
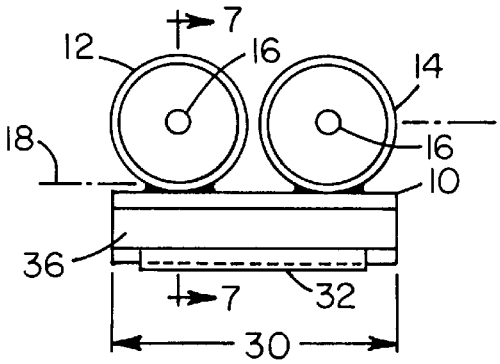
FIG. 6 is an axial end view of the device with a head means providing a lateral channel for receiving a disposable razor blade insert, with portions broken away for clarity and taken in the direction of line 6 in FIG. 4.
Figure 8:
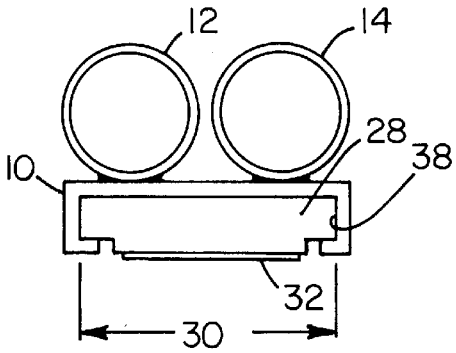
FIG. 8 is a view as in FIG. 6 showing an axially oriented channel in the base means for receiving a disposable razor blade and supporting head.
Figure 7:
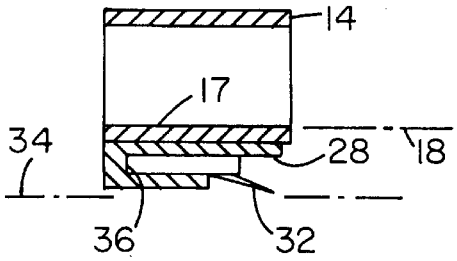
FIG. 7 is an axial cross-sectional view taken along line 7—7 of FIG. 6 in the direction of the arrows.

Referring to FIGS. 6–8, on the other hand, the blade 32 and its head or support means 28 are insertable into holding means provided in the base means, such as for example, and injector razor. In FIGS. 6 and 7, the holding means is a lateral slot 36 along dimension 30, and in FIG. 8 the holding means is an axial slot 38. The head means 28 is slidable into and out of these slots with sufficient and considerable friction such that the blade and head means are firmly and accurately positioned on the base means 10 when shaving.

Figure 10:
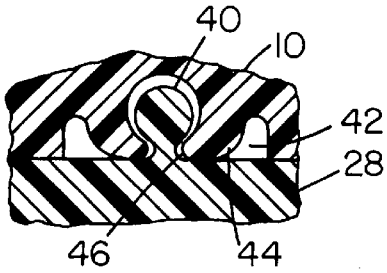
FIG. 10 is an enlarged cross-sectional view of a clip-on holder for the head.

The present device can employ any of the conventional razor blades and heads presently available in the market place simply by removing the handles of the heads where necessary and conforming the shape of the head to fit into the present holding means or to be affixed in any manner to base 10. In this regard, as shown in FIG. 10, the head may be affixed to the base by quick-fit means such as snap-on or clip on means 40. In this structure annular grooves 42 are provided to allow outwardly flexing of wall 44 to receive round knob means 40 within bores 46.

Figure 9:
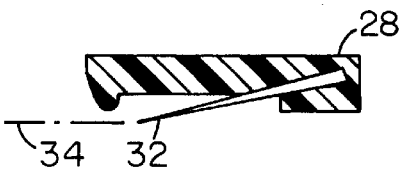
FIG. 9 is an enlarged cross-sectional view of the head with a blade affixed therein by molding in-situ.

The head means 28 and blade 32 can be of any convenient size and the head means can be configured to accommodate any type of blade including a single double edge blade or double blade. It is preferred however, that the blade be of the type which is permanently affixed to the head either by molding in-situ as shown, for example, in FIG. 9 or by locking the blade into the head by shoulder means or the like in a snap-in manner.

The rings, base and head of the device are preferably of plastic material such as polyolefin, polyamide, polyester, or the like, but can also be of metal. Also, the number of rings and their spacing on the base can be varied, depending on the finger condition of the user. For example, where the middle finger is missing or medically inappropriate for support or sensory use, the rings can be spaced along the base such as to be slidably mountable on the index and ring fingers.

Figure 11:
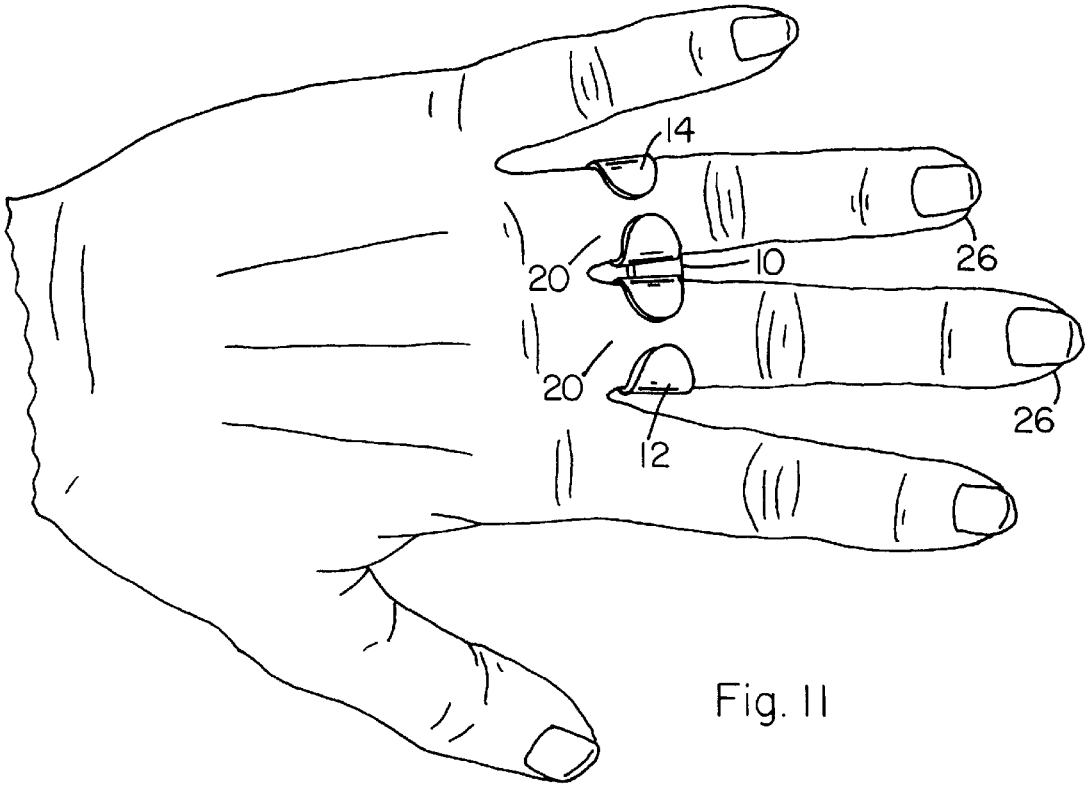
FIG. 11 is a view as in FIG. 2 but showing a variation of the finger gripping means.
Figure 12:
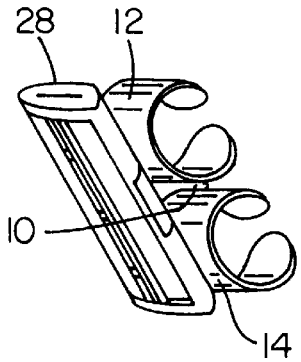
FIG. 12 is an isometric view of the device of FIG. 11.

Referring to FIGS. 11 and 12, the rings 12 and 14 are preferably of resilient, somewhat flexible material, e.g., plastic or light weight metal which can spread apart slightly to accommodate an) size finger, but which will then retract sufficiently tight on the finger to stabilize the device thereon.

The invention has been described in detail with particular reference to preferred embodiments thereof, but it will be understood that variations and modifications will be effected with the spirit and scope of the invention.

I claim:

1. A finger mountable, finger-pad sensory razor device having a base with at least two substantially tubular shaped finger gripping members such as rings or partial rings having substantially parallel longitudinal bore axes which are coextensive with finger axes and being supported on top of said base, each said gripping member having a lower bore portion lying in a finger pad first plane, each said gripping member being dimensioned to slidably, frictionally and longitudinally axially receive a finger substantially all the way to its proximal end while leaving the distal end of the finger exposed for sensory contact with the users skin, and razor blade head means having a shaving edge and being mounted on the bottom of said base, said shaving edge being oriented substantially laterally to said longitudinal bore axis in a shaving second plane, said longitudinal bore axes, said finger pad first plane and said shaving second plane being spaced apart successively from top to bottom of said device whereby, in concert with the shaving edge being oriented substantially laterally to said longitudinally bore and finger axes, a stroking motion of the hand generally axially of the forearm with the present device mounted on fingers will effect a hair shaving action with an attendant tactile monitoring by the pads of said finger of the hair stubble condition.

2. The device of claim 1 wherein each said gripping means comprises a full or partial ring member.

3. The device of claim 2 wherein said ring members, said base means, and said blade head means are provided as a single integral unit.

4. The device of claim 1 wherein said base means and said blade head means are provided with cooperating structural elements of quick-fit means whereby said blade head and blade means can be quickly and easily replaced.

5. The device of claim 4 wherein said elements comprise knob means on one of said base means or blade head means, and cooperating bore means on the other of said base means or head means.

6. The device of claim 1 wherein holding means for said blade head means is provided on said base means whereby said blade head means can be quickly and easily removed from replaced on said base means.

7. The device of claim 6 wherein said holding means comprises slot means in said base means for frictionally receiving said blade head means.

8. The device of claim 2 wherein said ring means have axial dimensions of from about one half to one inch.

* * * * *